United States Patent [19]

Schoenwetter

[11] Patent Number: 4,671,510

[45] Date of Patent: Jun. 9, 1987

[54] WEIGHTED RACQUET COVER

[75] Inventor: Henry Schoenwetter, Fort Lauderdale, Fla.

[73] Assignee: Hanx Associates, Plantation, Fla.

[21] Appl. No.: 824,712

[22] Filed: Jan. 31, 1986

[51] Int. Cl.[4] ..... A63B 69/38

[52] U.S. Cl. ..... 273/29 A; 273/74

[58] Field of Search ..... 273/74, 29 A; 150/52 G; 272/117, 124, 125

[56] References Cited

U.S. PATENT DOCUMENTS

| | | | |
|---|---|---|---|
| D. 231,150 | 4/1974 | Berry et al. . | |
| *238,214 | 12/1975 | Rivera | 150/52 G |
| 2,134,411 | 10/1938 | Max | 273/74 |
| 2,676,803 | 4/1954 | Damske | 273/35 |
| 2,737,394 | 3/1956 | Abel | 273/194 |
| 2,926,912 | 3/1960 | Gould | 273/74 |
| 3,398,961 | 8/1968 | Higdon | 273/194 |
| 3,943,989 | 3/1976 | Sperling | 150/52 R |
| 4,000,893 | 1/1977 | Evans | 273/29 A |
| 4,040,632 | 8/1977 | Pawl | 273/29 A |
| 4,052,061 | 10/1977 | Stewart | 273/29 A |
| 4,090,543 | 5/1978 | Chyten | 150/52 G |
| 4,213,614 | 7/1980 | Phillippi | 273/194 |
| 4,247,097 | 1/1981 | Schwartz | 272/119 |
| 4,371,983 | 2/1983 | Piotti, Jr. | 2/19 |

*Primary Examiner*—Richard C. Pinkham
*Assistant Examiner*—T. Brown
*Attorney, Agent, or Firm*—Oltman and Flynn

[57] ABSTRACT

Tennis and racquetball players use practice swings to warm up much the same as baseball players swing several bats just before going to bat. The present invention allows a common racquet cover to function as a warm up aid by providing balanced weight holding pockets on the face of the cover. Variable weights are placed symmetrically around the center line of the cover to provide constant rotational torque resistance during a practice swing. Interchangeable weights can simulate the weight of the playing ball. Thus, all levels of players can practice their shots just before playing ball.

10 Claims, 9 Drawing Figures

WEIGHTED RACQUET COVER

FIELD OF THE INVENTION

The pressent invention relates to improving the effectiveness of practice swings when warming up with a racquet.

BACKGROUND OF THE INVENTION

Sports which use a swinging implement include baseball, golf and tennis. Every athlete has been taught the value of warming up before play by swinging a weighted practice implement. The classic example of such warm up swings is the baseball player swinging two or three bats at once, or a weighted bat, before his turn at bat. The value of practice swinging with a weighted implement is rooted in the body's ability to concentrate on the complex muscle movements in slow motion prior to executing the motions at full speed. In slow motion practice swings the mind is refreshed on how to execute the precise motions needed for a home run, birdie or down the line winner. Additional physical benefits are derived from stressing and flexing the necessary muscles and soft tissues in slow motion prior to full exertion.

None of the prior art known to the applicant addresses the peculiar needs of a weighted warm up cover for a racquet. A racquet requires that a means be provided to balance various weights across the face of the racquet in order to maintain a consistent rotational resistance while swinging. Without such balanced forces, the racquet face will plunge into a horizontal plane while swinging instead of remaining in the preferred vertical plane. Such plunging would improperly prepare the player for proper racquet control during the game, and thereby defeat the purpose of warm up swings.

SUMMARY OF THE INVENTION

It is, therefore, the object of the present invention to provide a weighted cover for a racquet wherein the cover has means for holding the weights symmetrically positioned across the face of the racquet in order to prevent rotation of the racquet face during a swing.

Another object of the present invention is to provide a simple means to vary the amount of weights in the cover.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Figure 1:
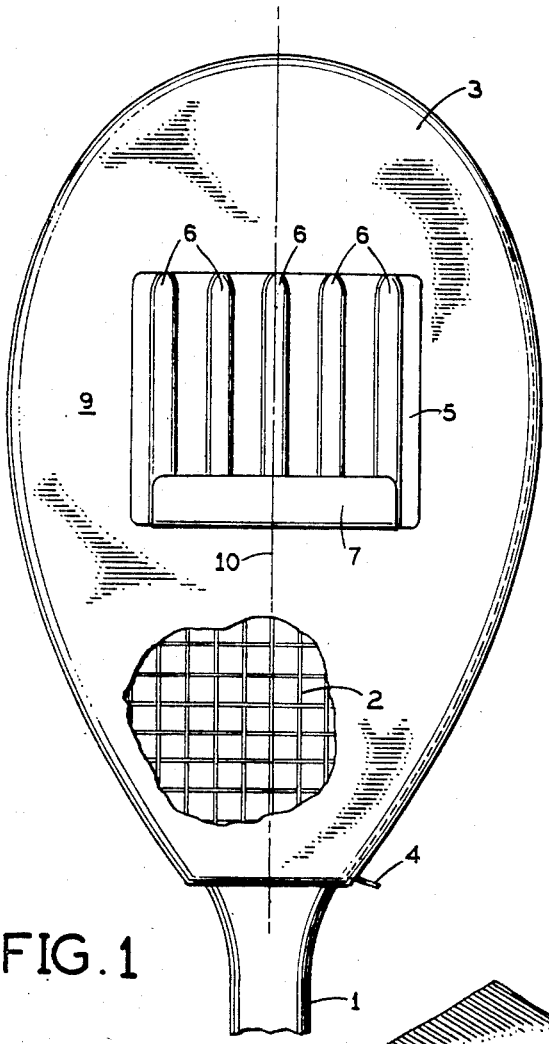
FIG. 1 is a front elevational view of a tennis racquet with a weighted cover showing a partial cut-away view of the racquet strings.

Referring first to FIG. 1, racquet 1 could be any type of sports racquet for tennis, racquet ball, or squash, for example. The strings 2 and frame (not shown) are covered by a cover 3 held on by a zipper 4. Cover 3 has centrally located flexible material 5 forming pockets 6 equidistantly spaced across the center line 10 of the racquet face 9.

Figure 2:
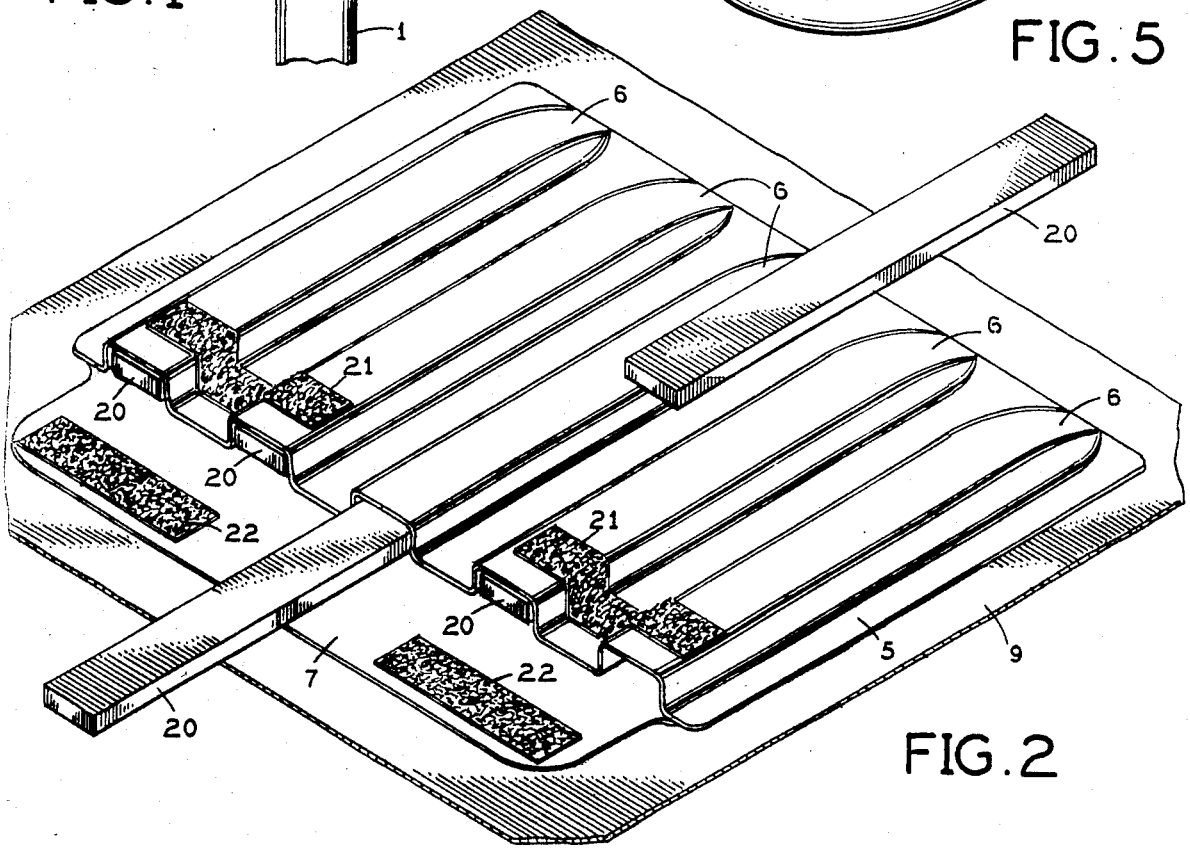
FIG. 2 is a fragmentary top plan view of the weighted racquet cover pockets.

FIG. 2 shows the material 5 of FIG. 1 with the pockets 6 holding weights 20 by means of a closing flap 7. This embodiment uses Vélcro® hooks 21 and piles 22 to close flap 7. The weights 20 should be sized to approximate the weight of the playing ball ($2\frac{1}{2}$ ounces for tennis and $1\frac{1}{2}$ ounces for racquetball). However, a variety of weights may be provided to offer a variety of practice swing combinations for players of various levels. Critical to the present invention is that weights 20 be added symmetrically around center line 10 of the racquet (see FIG. 1) in order to maintain a balanced rotational torque during the swing. A selection of 1, 2, 3, 4 or 5 weights is possible.

Figure 3:
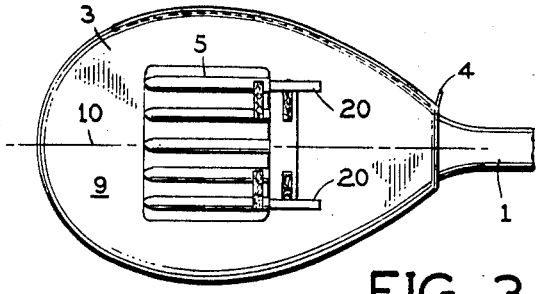
FIG. 3 is a front elevational view of the racquet in the horizontal plane ready for a practice swing with the cover having two weights in the outermost pockets.
Figure 4:
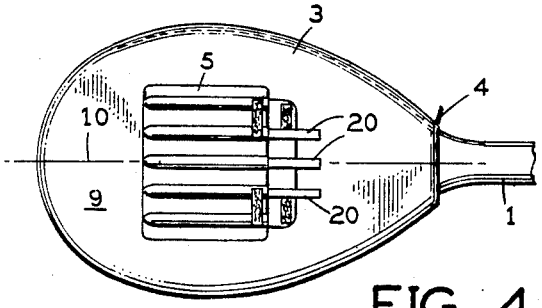
FIG. 4 is the same as Figure 3 with the cover having two weights in the intermediate pockets and one weight in the center.
Figure 5:
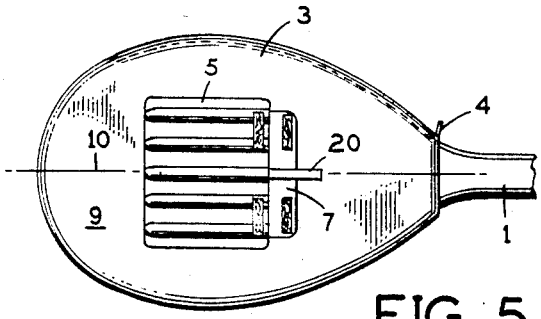
FIG. 5 is the same as Figure 3 with the cover having one weight in the center pocket illustrating that several combinations of weights can be selected.

FIGS. 3, 4 and 5 show various combinations of weights 20 having symmetry around center line 10. It should be noted that advanced players may purposely unbalance the distribution of weights 20 in order to practice topspin or backspin strokes.

Figure 6:
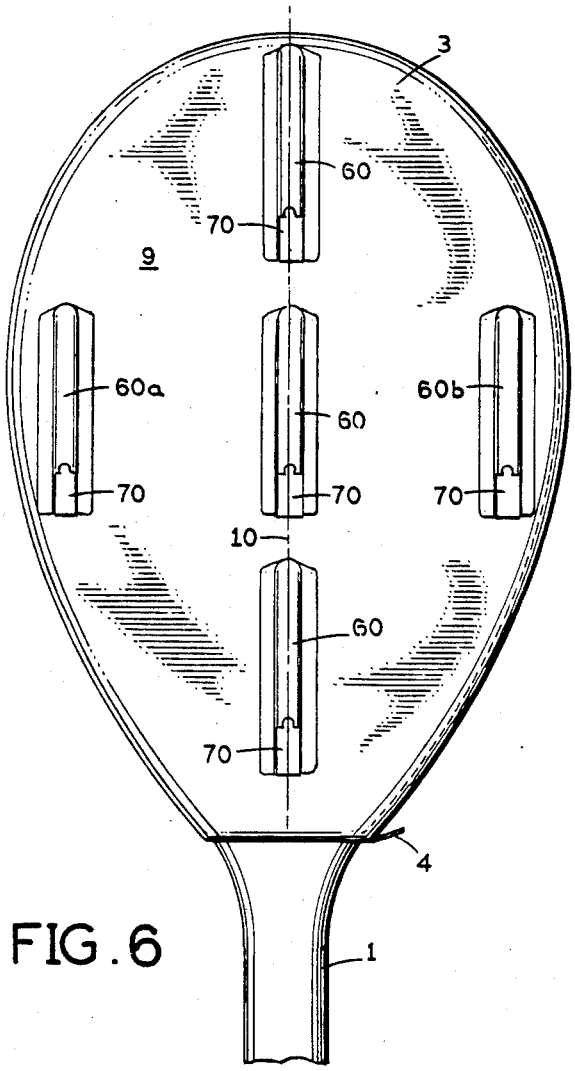
FIG. 6 is a front elevational view of a tennis racquet having a different embodiment of the cover with balanced, separated weight pockets.

FIG. 6 shows racquet 1 having cover 3 held on by zipper 4 wherein the embodiment of weight holding pockets 60 distributes more weight to the border of the racquet face 9. Pockets 60 have closing flaps 70 holding weights 20 (see FIG. 7). Border mounted pockets 60A anmd 60B allow advanced players to custom groove their warm up strokes to desired levels of rotational torque along centerline axis 10.

Figure 7:
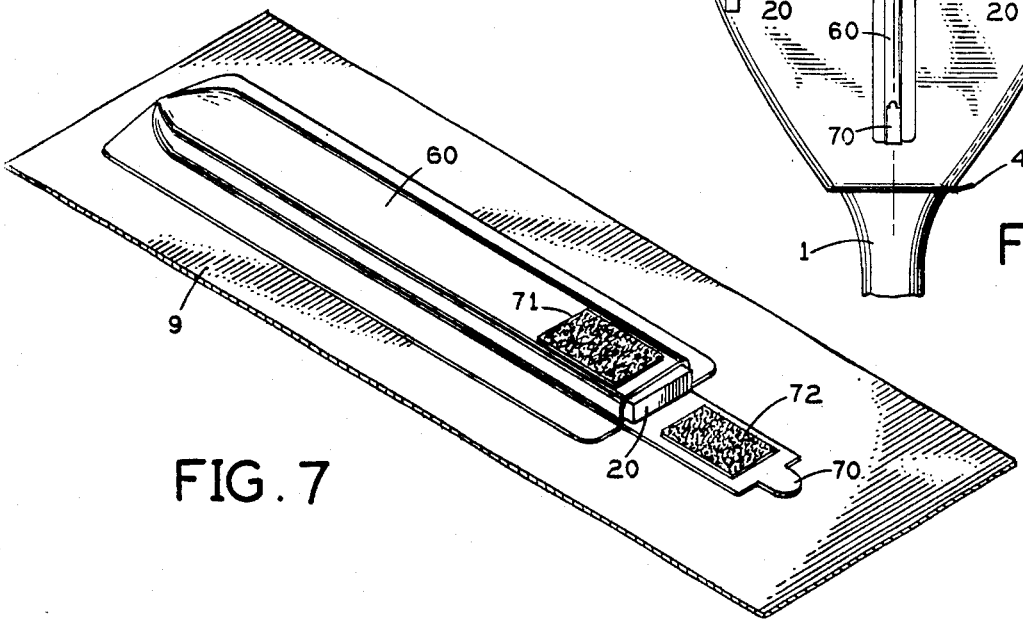
FIG. 7 is a top plan view of one pocket from the cover in FIG. 6.

FIG. 7 shows a weight pocket 60 on cover surface 9 wherein weight 20 is held in place by flap 70. Velcro® hooks 71 and pile 72 are used in this embodiment to hold flap 70 closed .

Figure 8:
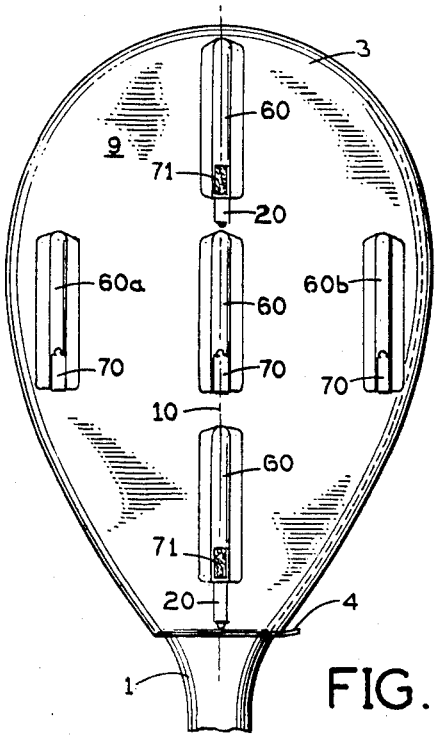
FIG. 8 is a front elevational view of a tennis racquet with the cover having two weights along the center line of the racquet.

FIG. 8 shows two weights 20 mounted in pockets 60 in the centerline plane 10.

Figure 9:
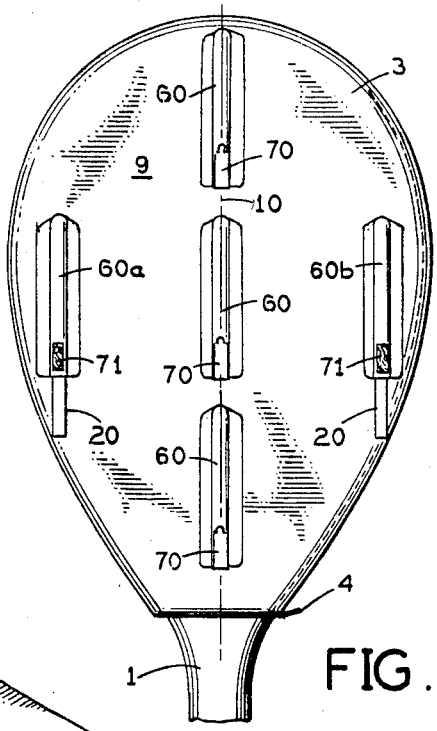
FIG. 9 is a front elevational view of a tennis racquet with the cover having two weights at the outer border of the racquet face.

FIG. 9 shows two weights 20 mounted in pockets 60A and 60B at the borders of racquet face 9.

A selection of 1, 2, 3, 4 or 5 weights is possible.

The material forming the pockets may be stitched or heat sealed to the cover, for example. The bottoms of the pockets point away from the handle opening of the cover to reduce pressure on the pocket closing flaps during a swing. The material of the cover and the material of the pockets may be the same. Any suitable flexible material such as plastic or fabric may be used for the cover and the pockets.

I claim:

1. For use on a sporting racquet which has a handle and a racquet head attached to the handle, said racquet head being symmetrical on opposite sides of a longitudinal centerline aligned with the handle, the combination of:

a cover contoured to fit snugly over the racquet head;

a plurality of pockets on the outside of said cover, each of said pockets having an opening therein, said pockets being symmetrically arranged laterally of the longitudinal centerline of the racquet head carrying the cover;

closure means for said pocket openings selectively operable manually to either close or open each of said pocket openings;

and a plurality of weights slidably insertable individually into and removable from said pockets through said openings, said weights being shaped and dimensioned to be snugly positioned individually in said pockets and symmetrically arranged laterally of said longitudinal centerline to maintain a balanced rotational torque of the racquet head carrying said cover and said inserted weights.

2. The combination of claim 1 wherein:

each of said pockets is elongated lengthwise of the racquet head carrying the cover in a direction longitudinally of the handle of the racquet;

and each of said weights fits snugly inside a corresponding pocket along substantially the entire length of said pocket.

3. The combination of claim 2 wherein:

each of said pocket openings is at the end of the corresponding pocket which is toward the handle when the cover is on the racquet head;

and said closure means comprises flexible flap means for covering said openings and manually separable fastener elements on said pockets and said flap means for holding said flap means positioned closing said openings.

4. The combination of claim 3 wherein:

said pockets are closely spaced apart laterally across said cover;

and said flap means is a single wide flap for simultaneously closing the openings in all of said pockets.

5. The combination of claim 3 wherein:

said pockets include pockets spaced apart in succession along the longitudinal centerline of the cover.

6. The combination of claim 5 wherein:

said pockets include additional pockets offset laterally on opposite sides of the longitudinal centerline of the cover.

7. The combination of claim 1 wherein :

each of said pockets has an end which is positioned toward the handle when the cover is on the racquet head, and said opening in each pocket is on said end of that pocket;

and said closure means comprises flexible flap means for covering said openings and manually separable fastener elements on said pockets and said flap means for holding said flap means positioned closing said openings.

8. The combination of claim 7 wherein:

said pockets are closely spaced apart laterally across said cover;

and said flap means is a single wide flap for simultaneously closing the openings in all of said pockets.

9. The combination of claim 7 wherein:

said pockets include pockets spaced apart in succession along the longitudinal centerline of the cover.

10. The combination of claim 9 wherein:

said pockets include additional pockets offset laterally on opposite sides of the longitudinal centerline of the cover.

* * * * *